US011530460B1

(12) United States Patent
Qiao

(10) Patent No.: US 11,530,460 B1
(45) Date of Patent: Dec. 20, 2022

(54) LOW-CARBON IRON-BASED ALLOY USEFUL FOR VALVE SEAT INSERTS

(71) Applicant: L.E. Jones Company, Menominee, MI (US)

(72) Inventor: Cong Yue Qiao, Menominee, MI (US)

(73) Assignee: L.E. Jones Company, Menominee, MI (US)

( * ) Notice: Subject to any disclaimer, the term of this patent is extended or adjusted under 35 U.S.C. 154(b) by 0 days.

(21) Appl. No.: 17/368,261

(22) Filed: Jul. 6, 2021

(51) Int. Cl.

| | |
|---|---|
| ***C22C 38/44*** | (2006.01) |
| ***C21D 9/00*** | (2006.01) |
| ***C22C 38/54*** | (2006.01) |
| ***C22C 38/52*** | (2006.01) |
| ***C22C 38/48*** | (2006.01) |
| ***C22C 38/46*** | (2006.01) |
| ***C22C 38/42*** | (2006.01) |
| ***C22C 38/06*** | (2006.01) |
| ***C22C 38/02*** | (2006.01) |
| ***C22C 38/00*** | (2006.01) |
| ***C21D 6/00*** | (2006.01) |
| ***F01L 3/02*** | (2006.01) |
| ***C22C 38/58*** | (2006.01) |

(52) U.S. Cl.

CPC ..... *C21D 9/0068* (2013.01); *C21D 6/004* (2013.01); *C21D 6/005* (2013.01); *C21D 6/007* (2013.01); *C21D 6/008* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/52* (2013.01); *C22C 38/54* (2013.01); *C22C 38/58* (2013.01); *F01L 3/02* (2013.01); *C21D 2211/001* (2013.01); *C21D 2211/005* (2013.01); *F01L 2301/00* (2020.05); *F01L 2303/00* (2020.05)

(58) Field of Classification Search
None
See application file for complete search history.

(56) References Cited

U.S. PATENT DOCUMENTS

| | | | | | |
|---|---|---|---|---|---|
| 3,151,978 | A * | 10/1964 | Cameron | C22C 38/44 | 420/47 |
| 5,674,449 | A * | 10/1997 | Liang | C22C 38/24 | 420/101 |
| 2019/0055860 | A1* | 2/2019 | Qiao | C22C 38/001 | |

* cited by examiner

*Primary Examiner* — Seth Dumbris
*Assistant Examiner* — Kim S. Horger
(74) *Attorney, Agent, or Firm* — Buchanan Ingersoll & Rooney PC

(57) ABSTRACT

A low-carbon iron-chromium-molybdenum alloy comprises, in weight percent: carbon from about 0.1 to about 0.8 percent; manganese from about 0.1 to about 4 percent; silicon from about 0.1 to about 0.5 percent; chromium from 14 to about 16 percent; nickel up to about 8 percent; vanadium up to about 0.1 percent; molybdenum from 14 to about 16 percent; tungsten up to about 6 percent; niobium from about 0.1 to about 0.8 percent; cobalt up to about 0.2 percent; boron up to 0.1 percent; nitrogen up to about 0.1 percent; copper up to about 1.5 percent; sulfur up to about 0.05 percent; phosphorus up to about 0.05 percent; balance iron from about 50 to about 65 percent; and incidental impurities wherein the alloy contains a ratio of Cr/Mo of about 0.9 to about 1.1. The alloy can be used as a valve seat insert for combustion engines.

14 Claims, 20 Drawing Sheets

LOW-CARBON IRON-BASED ALLOY USEFUL FOR VALVE SEAT INSERTS

FIELD

The present disclosure relates to iron-based alloys, in particular to corrosion and wear-resistant iron-based alloys with sustained strength and hardness capability in a wide temperature range that may be used, for example, in valve seat inserts.

BACKGROUND

More restrictive exhaust emissions laws for diesel engines have driven changes in engine design including the need for high-pressure electronic fuel injection systems. Engines built according to the new designs use higher combustion pressures, higher operating temperatures and less lubrication than previous designs. Components of the new designs, including valve seat inserts (VSI), have experienced significantly higher wear rates. Exhaust and intake valve seat inserts and valves, for example, must be able to withstand a high number of valve impact events and combustion events with minimal wear (e.g., abrasive, adhesive and corrosive wear). This has motivated a shift in materials selection toward materials that offer improved wear resistance relative to the valve seat insert materials that have traditionally been used by the diesel industry.

Another emerging trend in diesel engine development is the use of EGR (exhaust gas recirculation). With EGR, exhaust gas is partially routed back into the intake air stream to reduce nitric oxide ($NO_x$) content in exhaust emissions. The use of EGR in diesel engines can change engine combustion characteristics and consequently the valve/VSI working environment. Accordingly, there is a need for lower cost exhaust valve seat inserts having suitable metallurgical and mechanical properties for use in diesel engines using EGR.

Also, because exhaust gas contains compounds of nitrogen, sulfur, chlorine, and other elements that potentially can form acids, the need for improved corrosion resistance for alloys used in intake and exhaust valve seat insert applications is increased for diesel engines using EGR. Acid can attack valve seat inserts and valves leading to premature engine failure.

There is a need for improved iron-based alloys for valve seat inserts that exhibit adequate hardness, as well as corrosion and wear resistance suitable for use in, for example, intake and exhaust valve seat insert applications.

SUMMARY

In embodiments, the present disclosure provides a low-carbon iron-based alloy containing, in weight percent, carbon from about 0.1 to about 0.8 percent; manganese from about 0.1 to about 4 percent; silicon from about 0.1 to about 0.5 percent; chromium from 14 to about 16 percent; nickel up to about 8 percent; vanadium up to about 0.1 percent; molybdenum from 14 to about 16 percent; tungsten up to about 6 percent; niobium from about 0.1 to about 0.8 percent; cobalt up to about 0.2 percent; boron up to 0.1 percent; nitrogen up to about 0.1 percent; copper up to about 1.5 percent; sulfur up to about 0.05 percent; phosphorus up to about 0.05 percent; aluminum up to about 0.005 percent; balance iron from about 50 to about 65 percent; and incidental impurities wherein the alloy contains a ratio of Cr/Mo of about 0.9 to about 1.1.

In an embodiment, the alloy comprises: carbon from about 0.15 to about 0.75 percent; manganese from about 0.2 to about 3 percent; silicon from about 0.2 to about 0.4 percent; chromium from 14.5 to about 15.5 percent; nickel from about 3 to about 6 percent; vanadium from about 0.02 to about 0.06 percent; molybdenum from 14.5 to about 15.5 percent; tungsten from about 0.02 to about 6 percent; niobium from about 0.1 to about 0.7 percent; cobalt from about 0.005 to about 0.1 percent; boron from about 0.005 to about 0.01 percent; nitrogen from about 0.04 to about 0.09 percent; copper from about 0.6 to about 1.2 percent; sulfur up to about 0.03 percent; phosphorus up to about 0.03 percent; aluminum up to about 0.005 percent; balance iron from about 53 to about 63 percent; and incidental impurities.

In another embodiment, the alloy comprises carbon from about 0.1 to about 0.8 percent; manganese from about 1 to about 3 percent; silicon from about 0.2 to about 0.4 percent; chromium from 14.5 to about 15.5 percent; nickel from about 5 to about 6 percent; vanadium up to about 0.1 percent; molybdenum from 14.5 to about 15.5 percent; tungsten about 4 to about 6 percent; niobium from about 0.1 to about 0.2 percent; cobalt up to about 0.1 percent; boron up to about 0.1 percent; nitrogen up to about 0.1 percent; copper 0.8 to about 1.2 percent; sulfur up to about 0.03 percent; phosphorus up to about 0.03 percent; aluminum up to about 0.005 percent; balance iron from about 50 to about 56 percent; and incidental impurities.

According to various embodiments, the alloy contains about 50 to about 65 weight percent iron, at least 3 percent nickel, at least 0.7 percent copper, up to 0.1 percent cobalt, up to 0.07 percent vanadium and up to 0.7 percent niobium, the alloy has a hardness of at least 47 Rockwell C, and/or the alloy has a microhardness (HV10) of at least 350 at a temperature of about 1000° F.

In an embodiment, the alloy consists essentially of, in weight percent: carbon from 0.1 to 0.8 percent; manganese from 0.2 to 3.5 percent; silicon from 0.1 to 0.4 percent; chromium from 14.5 to about 15.5 percent; nickel from 3 to 6.5 percent; vanadium up to 0.1 percent; molybdenum from 14.5 to about 15.5 percent; tungsten up to 6 percent; niobium up to 0.7 percent; cobalt up to 0.1 percent; boron up to 0.1 percent; nitrogen up to 0.1 percent; copper 0.7 to 1.2 percent; sulfur up to 0.03 percent; phosphorus up to 0.03 percent; aluminum up to 0.005 percent; balance iron from 50 to 65 percent; and incidental impurities wherein a ratio of chromium to molybdenum is 0.9 to 1.1.

In an exemplary embodiment, the alloy is cast into a cast part having a fully austenitic microstructure, a fully ferritic microstructure, or a duplex ferritic-austenitic microstructure. For example, the cast part can be a valve seat insert useful in combustion engines.

Figure 14:
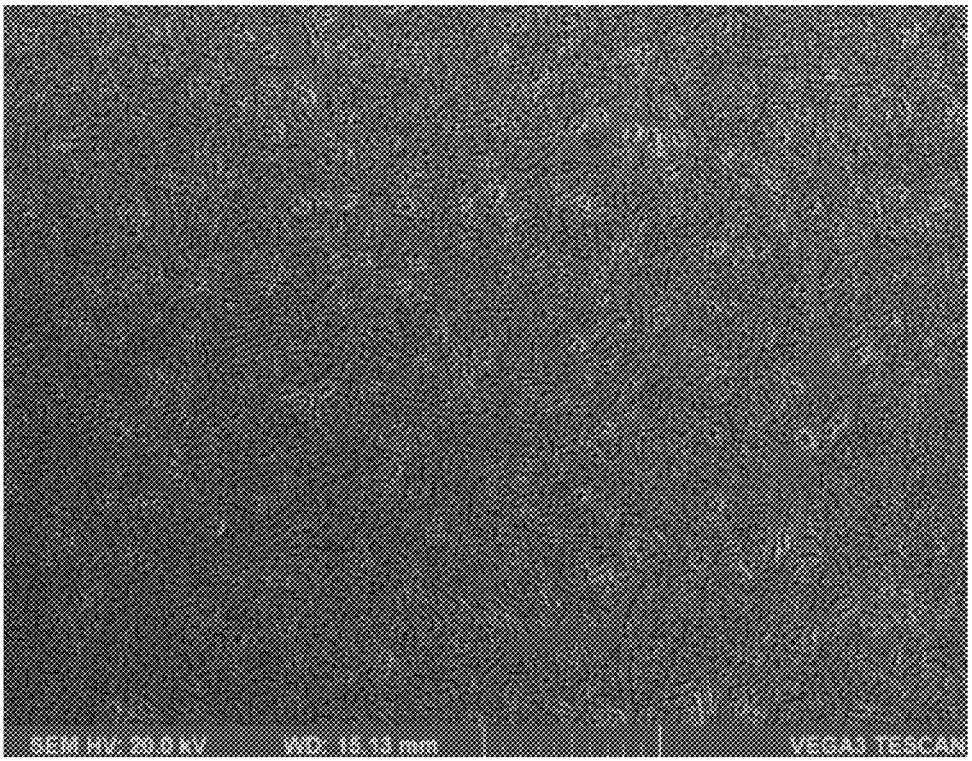
Figure 15:
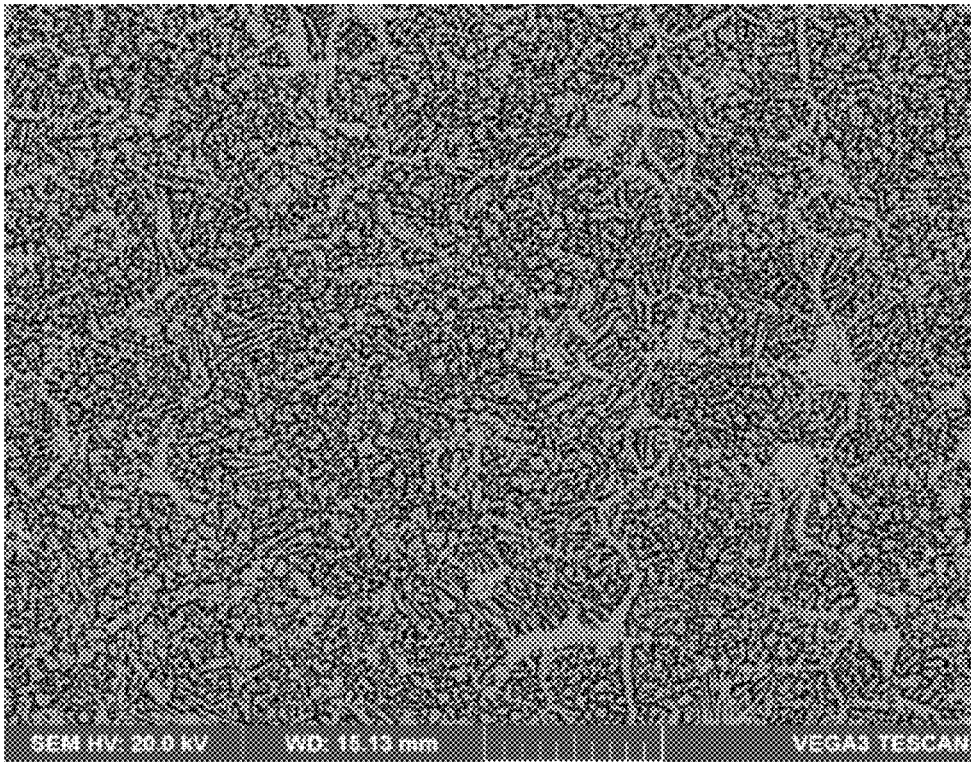

Higher magnification secondary electron image and backscattered electron image at 1000× are shown in FIGS. 14 and 15, respectively.

Figure 16:
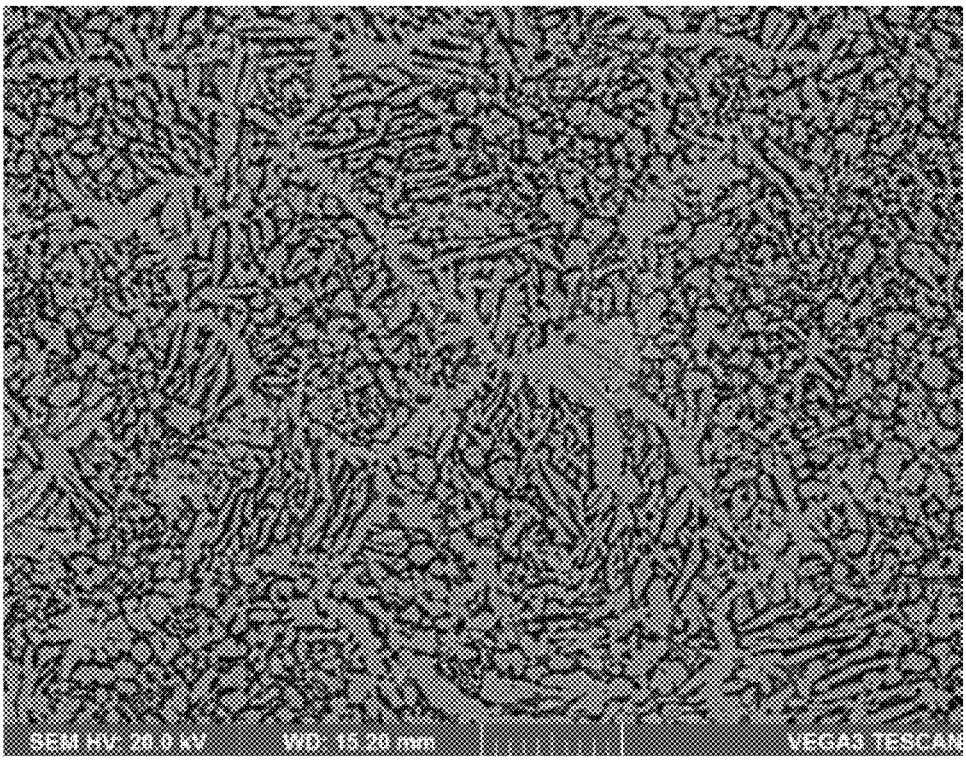

FIG. 16 is a backscattered electron image at even higher magnification in which small area EDS analysis, brighter area EDS analysis, and darker area EDS analysis were taken place at the locations marked in the figure.

Figure 17:
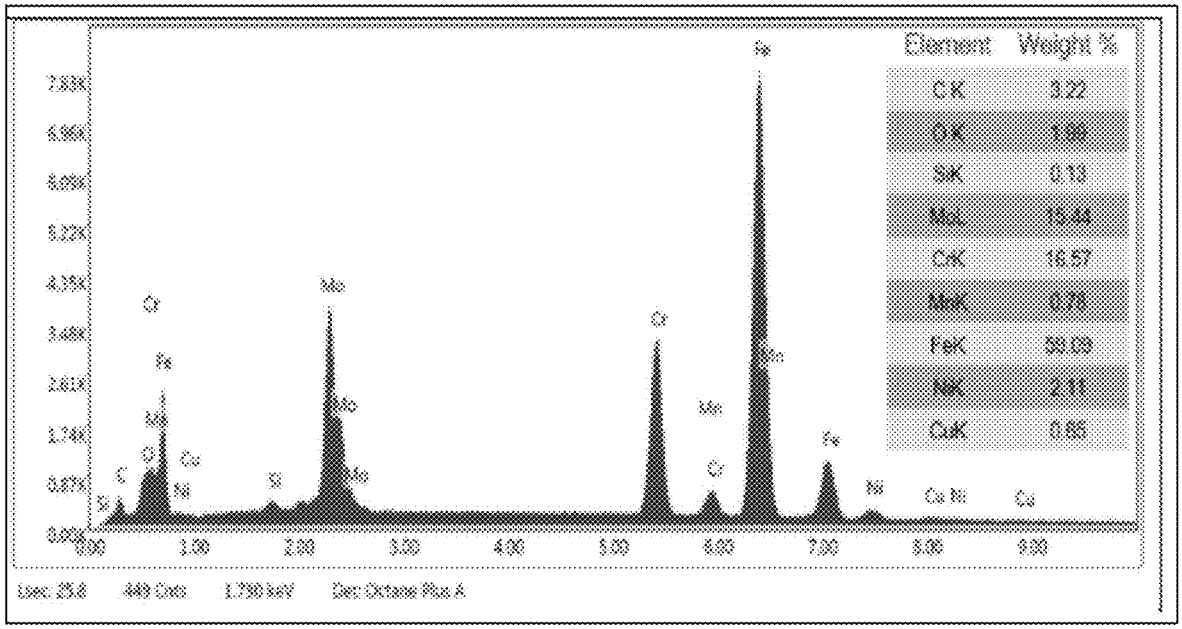
Figure 18:
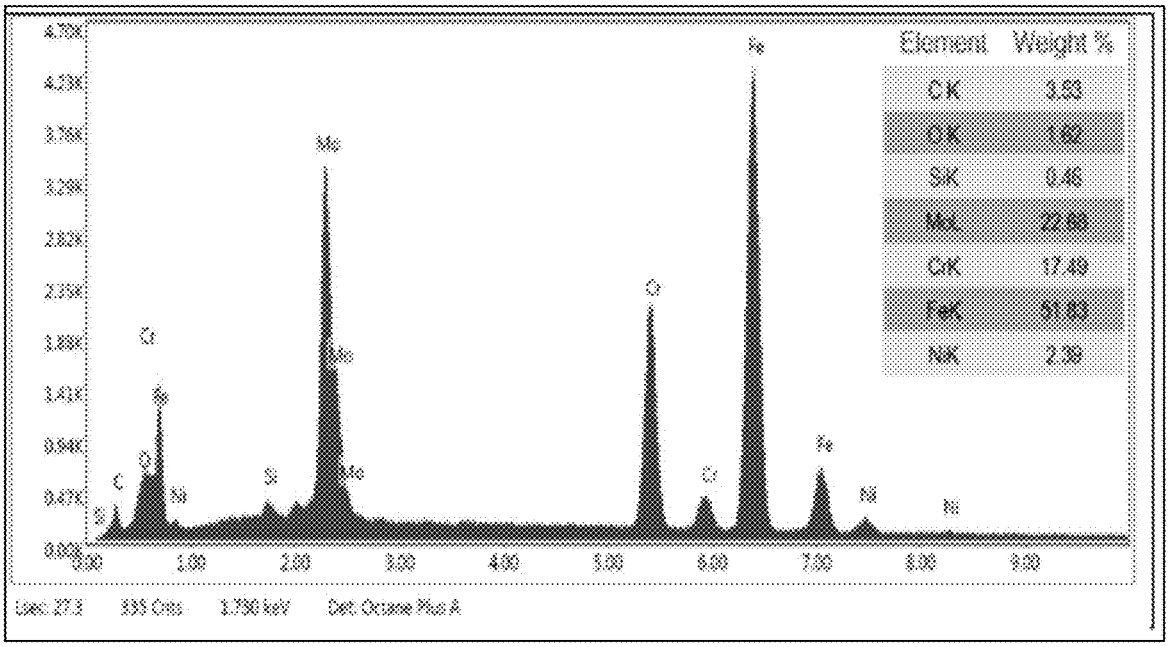
Figure 19:
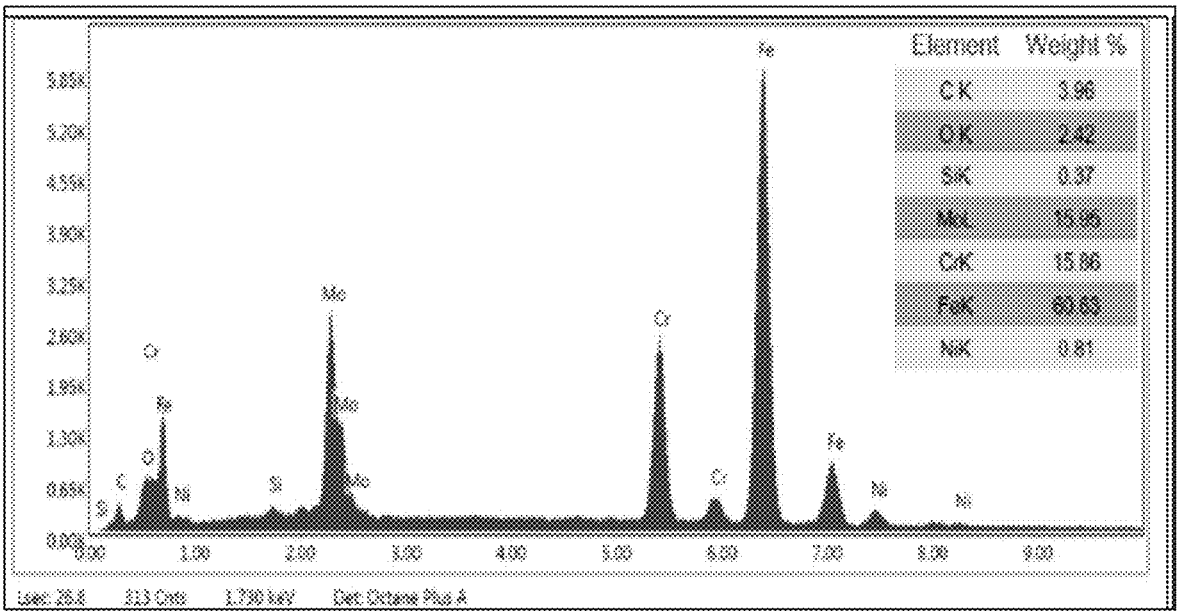

The EDS analysis results for above three locations are shown in FIGS. 17-19, respectively.

Figure 20:
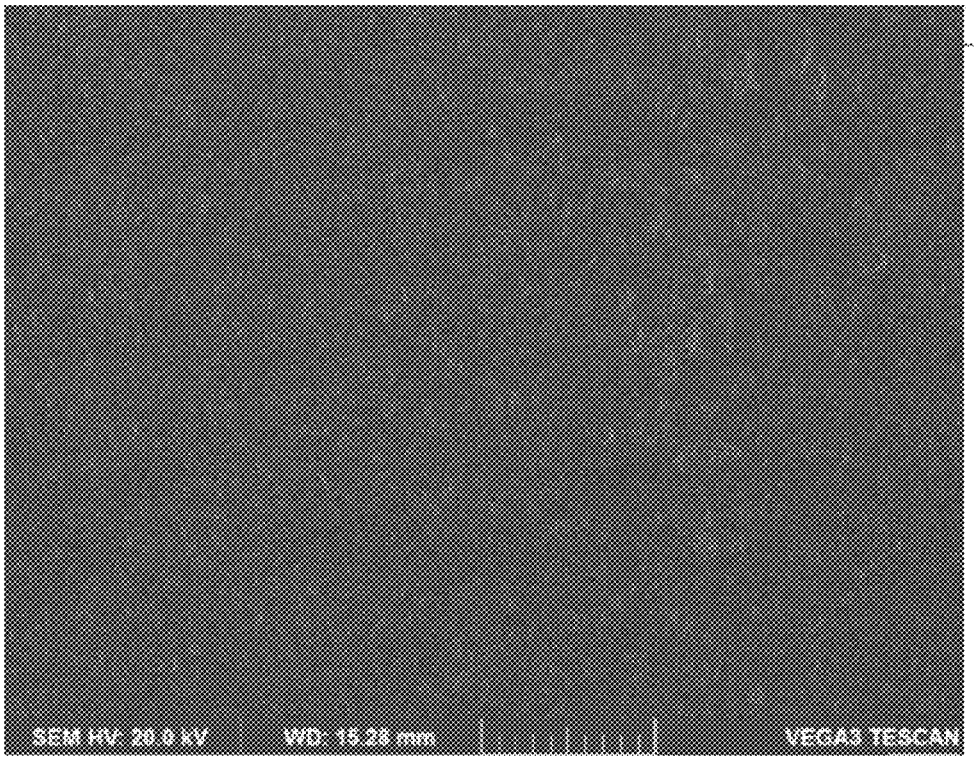

FIG. 20 shows a secondary electron image at 500× of alloy J304 Heat 8.

Figure 21:
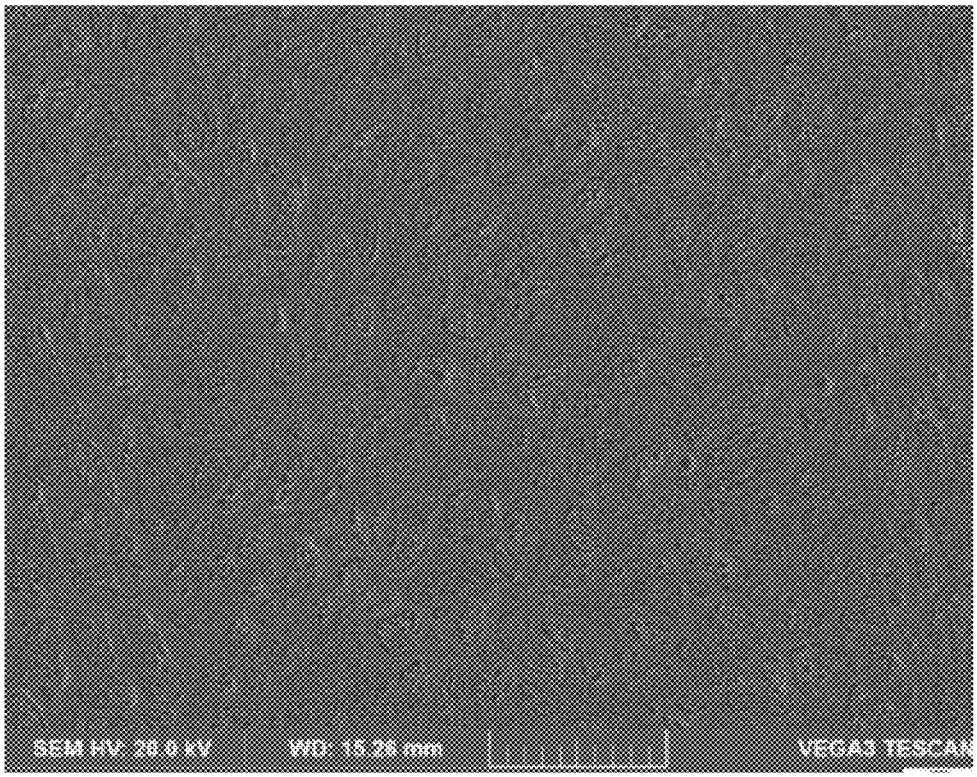
Figure 22:
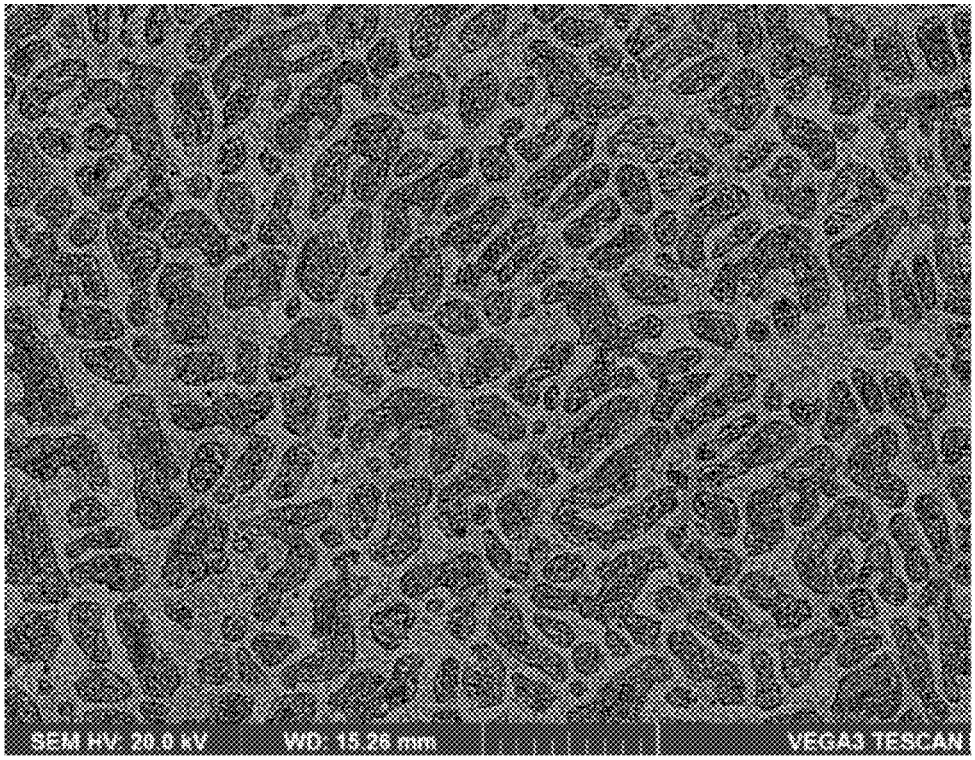

FIGS. 21 and 22 are secondary electron images at higher magnifications.

Figure 23:
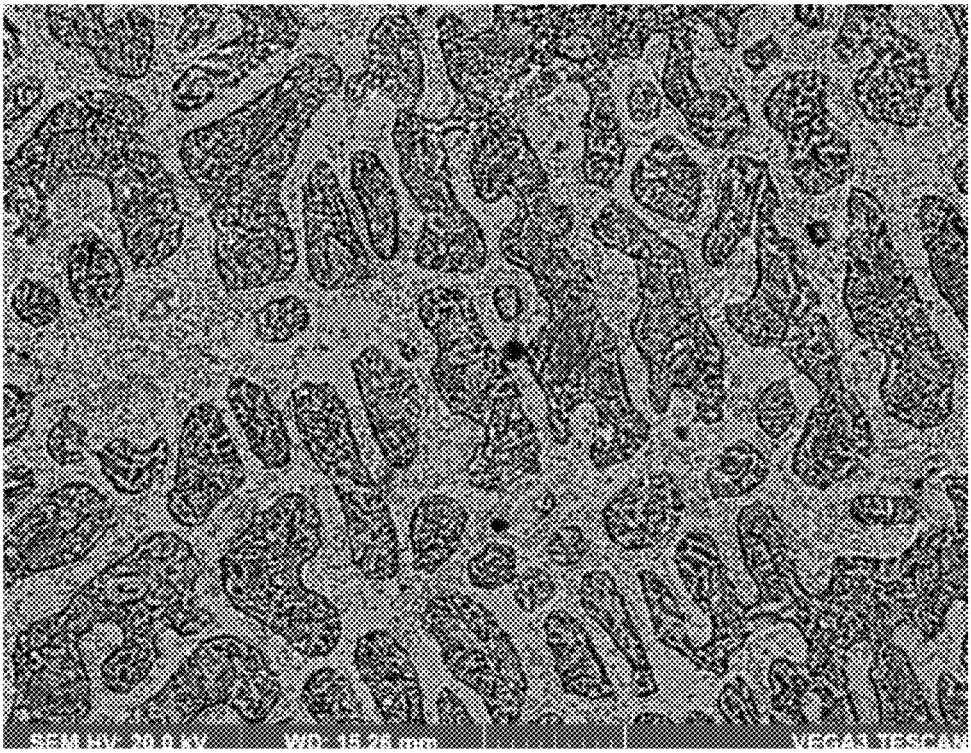

FIG. 23 shows an even higher magnification backscattered electron image at 2000× for J304 Heat 8 in which the locations EDS analyzed are marked.

Figure 24:
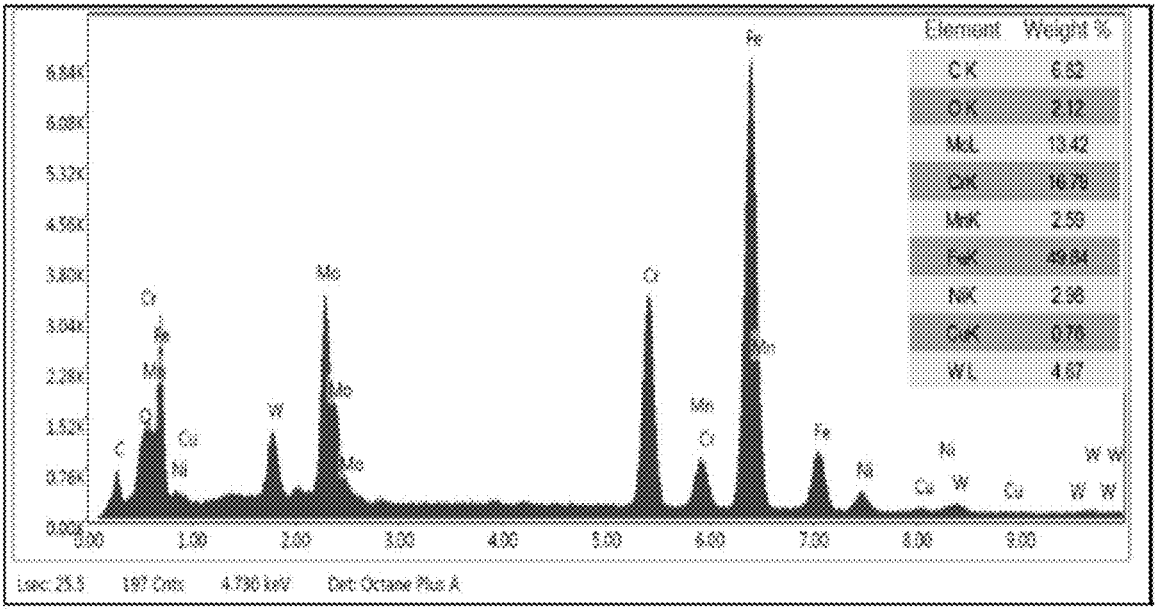
Figure 25:
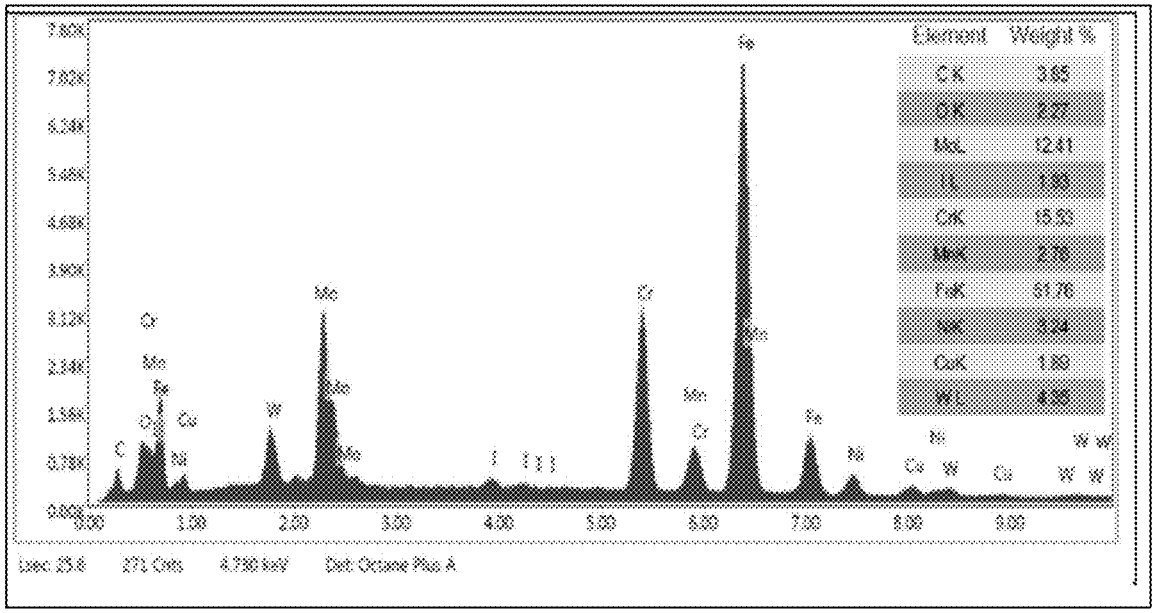
Figure 26:
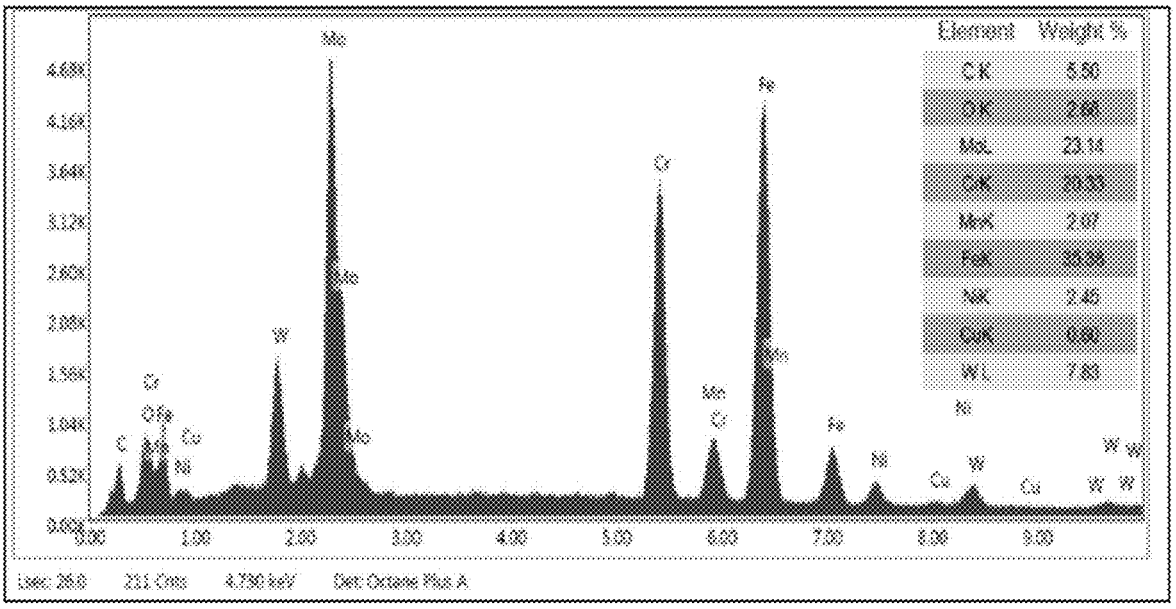

The EDS analysis results for above three locations are shown in FIGS. 24-26, respectively.

Figure 27:
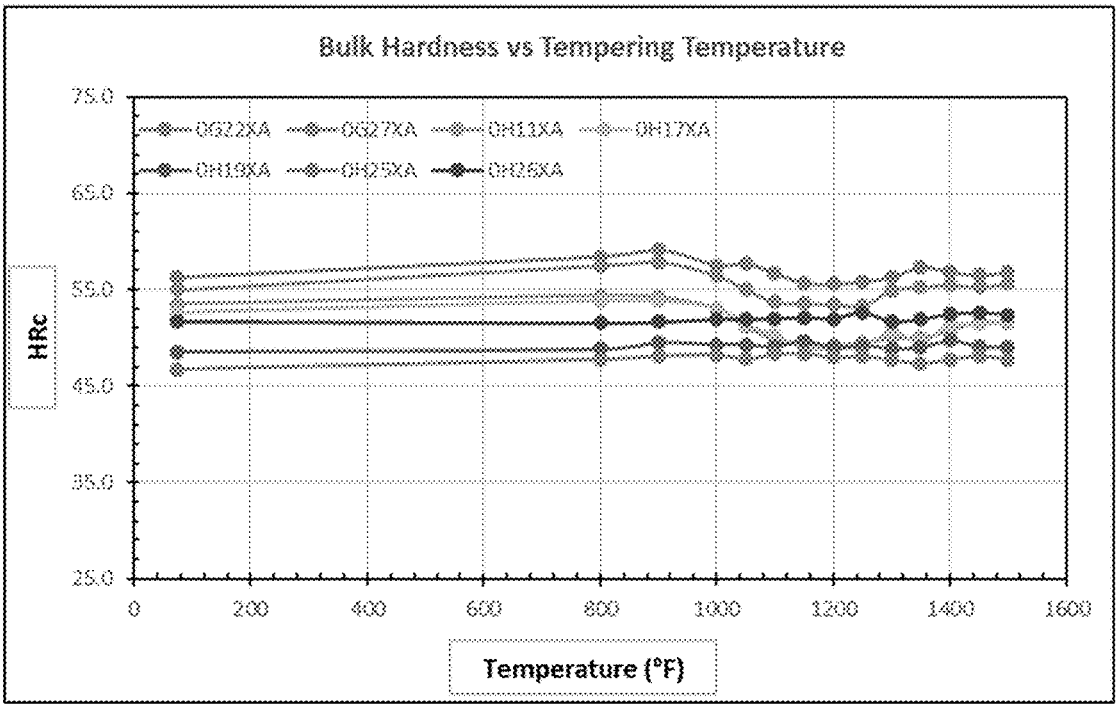

FIG. 27 is a graph of bulk hardness versus tempering temperature.

Figure 28:
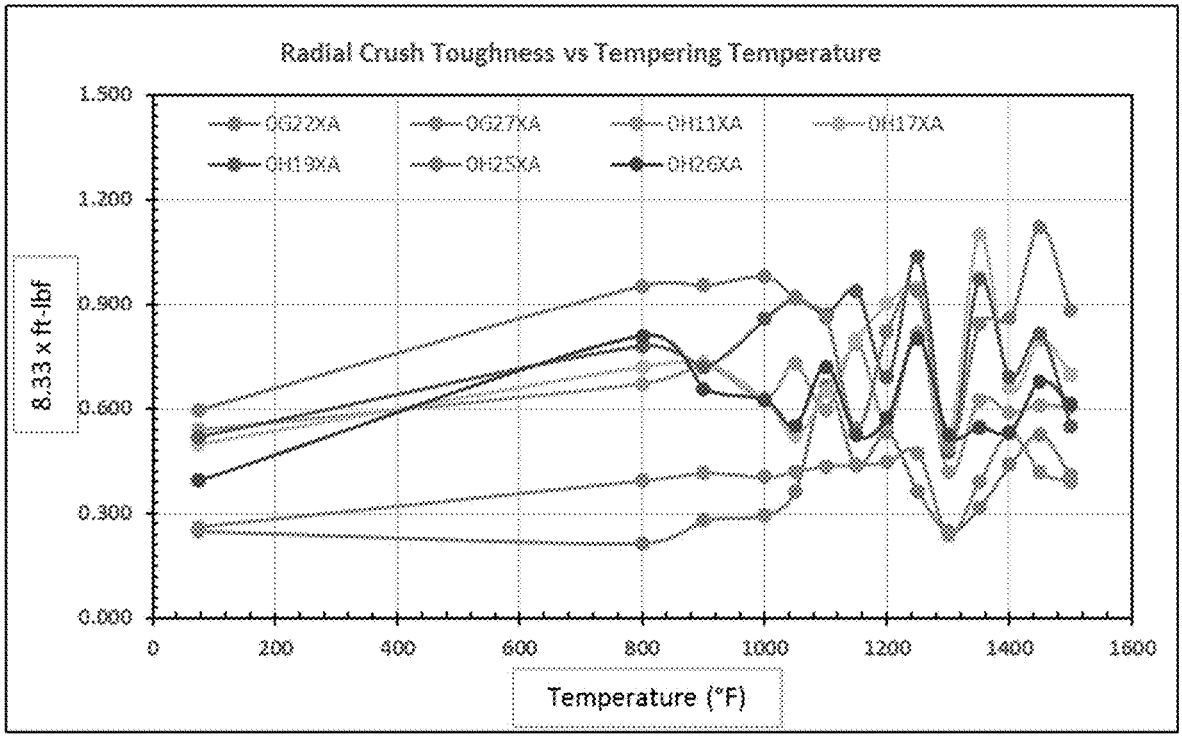

FIG. 28 is a graph of radial crush strength versus tempering temperature.

DETAILED DESCRIPTION

Disclosed herein is an iron-based alloy useful as a valve seat insert which will now be described in detail with reference to a few embodiments thereof, as illustrated in the accompanying drawings. In the following description, numerous specific details are set forth in order to provide a thorough understanding of the iron-based alloy. It will be apparent, however, to one skilled in the art that embodiments herein may be practiced without some or all of these specific details.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value. In this specification and the claims that follow, singular forms such as "a", "an", and "the" include plural forms unless the content clearly dictates otherwise.

The terms "room temperature", "ambient temperature", and "ambient" refer, for example, to a temperature of from about 20° C. to about 25° C.

Figure 1:
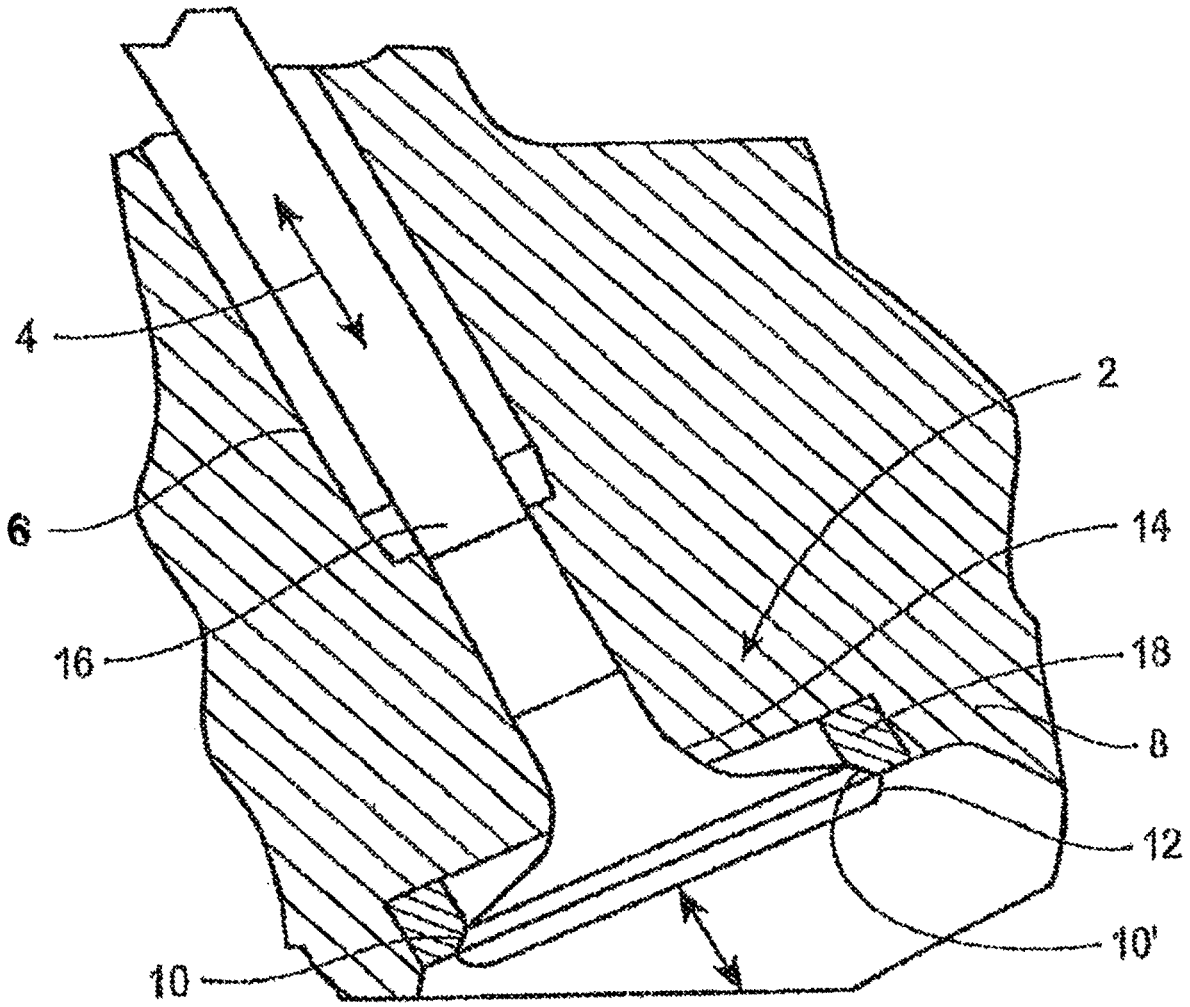
FIG. 1 is a cross-sectional view of a valve-assembly incorporating a valve seat insert of an iron-based alloy according to an embodiment of the instant application.

FIG. 1 illustrates an exemplary valve assembly 2 according to the present disclosure. Valve assembly 2 may include a valve 4, which may be slidably supported within the internal bore of a valve stem guide 6 and a valve seat insert 18. The valve stem guide 6 may be a tubular structure that fits into the cylinder head 8. Arrows illustrate the direction of motion of the valve 4. Valve 4 may include a valve seat face 10 interposed between the cap 12 and neck 14 of the valve 4. Valve stem 16 may be positioned above the neck 14 and may be received within valve stem guide 6. The valve seat insert 18 may include a valve seat insert face 10' and may be mounted, such as by press-fitting, within the cylinder head 8 of the engine. In embodiments, the cylinder head 8 may comprise a casting of, for example, cast iron, aluminum, or an aluminum alloy. In embodiments, the insert 18 (shown in cross-section) may be annular in shape, and the valve seat insert face 10' may engage the valve seat face 10 during movement of valve 4.

In embodiments, the present disclosure relates to an iron-based alloy (referred to hereafter as "J304 alloy" or "J304"). The bulk hardness, hot hardness, high temperature strength, corrosion resistance, and wear resistance of the J304 alloy make it useful in a variety of applications including, for example, as a valve seat insert for an internal combustion engine, and in ball bearings, coating materials, and the like. In embodiments, the alloy is used as a valve seat insert for an internal combustion engine.

In embodiments, the J304 alloy comprises, in weight percent, carbon from about 0.1 to about 0.8 percent or about 0.15 to about 0.75 percent; manganese from about 0.1 to about 4 percent or about 0.2 to 3 percent or about 1 to 3 percent or about 0.2 to about 3.5 percent; silicon from about 0.1 to about 0.5 percent or about 0.2 to about 0.4 percent or about 0.1 to about 0.4 percent; chromium from about 14 to about 16 percent or from about 14.5 to about 15.5 percent; nickel up to about 8 percent or about 3 to about 6 percent, or about 5 to about 6 percent, or at least 3 percent or about 3 to about 6.5 percent; vanadium up to about 0.1 percent, or about 0.02 to about 0.06 percent, or up to about 0.07 percent; molybdenum from about 14 to about 16 percent or from about 14.5 to about 15.5 percent; tungsten up to about 6 percent, or about 0.02 percent to about 6 percent, or about 4 to about 6 percent; niobium from about 0.1 to about 0.8 percent, or about 0.1 to about 0.7 percent or about 0.1 to about 0.2 percent, or up to about 0.7 percent; cobalt up to about 0.2 percent or about 0.005 to about 0.1 percent, or up to about 0.1 percent; boron up to about 0.1 percent or about 0.005 to about 0.01 percent; nitrogen up to about 0.1 percent or about 0.04 to about 0.09 percent; copper up to about 1.5 percent or about 0.6 to about 1.2 percent or about 0.8 to about 1.2 percent or at least about 0.7 percent or about 0.7 to about 1.2 percent; sulfur up to about 0.05 percent or up to about 0.03 percent; phosphorus up to about 0.05 percent or up to about 0.03 percent; aluminum up to about 0.005 percent; balance iron from about 50 to about 65 percent or about 53 to about 63 percent or about 50 to about 56 percent; and incidental impurities wherein the alloy contains a ratio of Cr/Mo of about 0.9 to about 1.1 or about 1.

In embodiments, the incidental impurities may include up to about 1.5 weight percent other elements, such as, arsenic, bismuth, calcium, magnesium, lead, tin, yttrium and rare earth elements (lanthanides), zinc, selenium, titanium, zirconium, hafnium, tantalum.

As used herein, the terms "consists essentially of" or "consisting essentially of" have a partially closed meaning—that is to say, such terms exclude steps, features, or components which would substantially and adversely change the basic and novel properties of the alloy (i.e., steps or features or components which would have a detrimental effect on the desired properties of the J304 alloy). The basic and novel properties of the J304 alloy may include at least one of the following: hardness, thermal expansion coefficient, compressive yield strength, wear resistance, corrosion resistance, and microstructure (i.e., substantially austenitic or fully austenitic, substantially ferritic or fully ferritic, or a substantially duplex ferritic-austenitic or fully ferritic-austenitic microstructure).

In embodiments, the J304 alloy may be processed to achieve a combination of hardness, wear resistance, and corrosion resistance suitable for valve seat inserts in as-cast or stress relief heat treated or hardened and tempered condition. In embodiments, the J304 alloy may be processed according to any suitable method; for example, in embodiments, the J304 may be processed by conventional techniques including powder metallurgy, casting, thermal/plasma spraying, weld overlay, and the like.

In embodiments, the J304 alloy may be formed into a metal powder by any suitable technique. Various techniques for forming the alloy into a metal powder include, for example, ball milling elemental powders or atomization to form pre-alloyed powder. In embodiments, the powder material may be compacted into a desired shape and sintered. The sintering process may be used to achieve desired properties in the resulting part.

In embodiments, a valve seat insert may be manufactured by casting, which is a process involving melting alloy constituents and pouring the molten mixture into a mold. In embodiments, the alloy castings may be subsequently heat treated before machining into a final shape. In embodiments, a valve seat insert may be manufactured by machining a piece of the J304 alloy.

In embodiments, the J304 alloy may be used in the manufacture of valve seat inserts, such as valve seat inserts for use in diesel engines (for example, diesel engines with or without EGR). In embodiments, the J304 alloy may be used in other applications including, for example, valve seat inserts made for gasoline, natural gas, bi-fuel, or alternatively fueled internal combustion engines. Such valve seat inserts may be manufactured by conventional techniques. In addition, the J304 alloy may find utility in other applications, including, for example, applications in which high temperature properties are advantageous, such as wear resistant coatings, internal combustion engine components, and diesel engine components.

In embodiments, the J304 has a fully austenitic microstructure, a fully ferritic microstructure, or a fully duplex ferritic-austenitic microstructure in the as-cast state and the alloy is optionally heat treated such as by hardening and tempering.

In embodiments, the J304 alloy may have a high level of sustained bulk hardness. For example, in embodiments, the J304 alloy may have a bulk hardness of about 43 to about 57 HRc, at temperatures ranging from room temperature to 1500° F.

Thermal conductivity of valve seat insert materials influences their performance—a valve seat insert material with high thermal conductivity can more effectively transfer heat away from engine valves in order to prevent overheating.

In embodiments, the J304 alloy may have a high ultimate tensile strength and compressive yield strength suitable for use in valve seat insert applications. In general, a greater ultimate rupture tensile strength corresponds to a greater resistance to insert cracking, and a greater compressive yield strength corresponds to high valve seat insert retention. In embodiments, the J304 alloy may have a compressive yield strength of greater than about 100 ksi and a tensile strength of greater than about 45 ksi at a temperature of about 75° F. In embodiments, the tensile strength at 1200° F. may be greater than about 32 ksi, such as greater than about 50 ksi. In embodiments, the difference between the tensile strength at 75° F. and that at 1200° F. may be less than about 20 ksi, such as less than about 15 ksi. In embodiments, the difference between the tensile strength at 75° F. and the tensile strength at 1000° F. may be less than about 10 ksi, such as less than about 8 ksi, or less than about 2 ksi.

In embodiments, the J304 alloy may have a microhardness (as carried out with the Vickers HV10 scale under vacuum conditions) suitable for valve seat insert applications.

Carbon is an alloying element in the J304 alloy, which may affect alloy castability, microstructure, solidification substructure, and mechanical metallurgical behavior. The J304 alloy contains a relatively low amount of carbon which contributes to improving stress rupture resistance of the J304 alloy. In embodiments, carbon may be present in the J304 alloy in an amount of from about 0.1 to about 0.8 weight percent, such as from about 0.15 to about 0.75 weight percent.

In embodiments, boron may optionally be used in the J304 alloy as an effective alloying element to increase the hardness level of the iron-based alloy system. Boron may also act as a grain refiner—fine grain and subgrain size improves not only the valve seat insert material wear performance, but also augments the bulk strength of the matrix. In embodiments, the J304 alloy may contain, for example, up to about 0.1% boron such as from about 0.005 to about 0.01 weight percent boron.

Manganese is an austenite former and, in embodiments, may be present in the J304 alloy in an amount of, for example, from about 0.1 to about 4 weight percent, such as from about 0.2 to about 3 weight percent, or from about 1 to about 3 weight percent, or from about 0.2 to about 3.5 weight percent.

In embodiments, the silicon content in the J304 alloy may be from about 0.1 to about 0.5 weight percent, such as from about 0.2 to about 0.4 weight percent silicon, or from about 0.1 to about 0.4 weight percent silicon. In embodiments, silicon can affect the castability and mode of solidification of the alloy.

In embodiments, the J304 alloy may contain chromium, a carbide and a ferrite former, in an amount of from about 14 to about 16 weight percent, such as from about 14.5 to about 15.5 weight percent chromium.

In embodiments, nickel, an austenite former, may be present in the J304 alloy in an amount of, for example, up to about 8 weight percent nickel, such as from about 3 to about 6 weight percent nickel, from about 5 to about 6 weight percent nickel, or from about 3 to about 6.5 weight percent nickel.

Vanadium is a carbide former and may, in embodiments, be present in the J304 alloy in an amount of, for example, up to about 0.1 weight percent, from about 0.02 to about 0.06 weight percent, or up to about 0.07 weight percent.

In embodiments, molybdenum, which is also a carbide former, may be present in the J304 alloy in an amount of, for example, from about 14 to about 16 weight percent molybdenum, such as from about 14.5 to about 15.5 weight percent molybdenum.

In embodiments, the J304 alloy can include tungsten in an amount up to about 6 weight percent, or from about 0.02 to about 6 weight percent, or about 4 to about 6 weight percent tungsten.

In embodiments, the J304 alloy may contain niobium, also a strong carbide former, in a suitable amount. For example, in embodiments, the J304 alloy may contain from about 0.1 to about 0.8 weight percent niobium, such as from about 0.1 to about 0.7 weight percent niobium, up to about 0.7 weight percent, or from about 0.1 to about 0.2 weight percent niobium.

In embodiments, the J304 alloy is cobalt-free but may contain a small amount of cobalt, an austenite former, in a suitable amount. For example, in embodiments, the J304 alloy may contain up to about 0.2 weight percent cobalt, such as up to about 0.1 weight percent, or about 0.005 to about 0.01 weight percent cobalt.

In embodiments, the J304 alloy can include copper in amounts of up to about 1.5 weight percent. For example, copper can be included in amounts of about 0.6 to about 1.2 weight percent, about 0.8 to about 1.2 weight percent, at least 0.7 weight percent, or about 0.7 to about 1.2 weight percent copper.

The J304 alloy can have optional additions of other alloying elements, or may be free of intentional additions of such elements. In embodiments, the balance of the J304 alloy is iron and incidental impurities, which can include up to about 2 weight percent total carbide formers such as tantalum, titanium, hafnium and zirconium and up to about 1.5 weight percent other elements, such as aluminum, arsenic, bismuth, calcium, magnesium, nitrogen, phosphorus, lead, sulfur, tin, yttrium and rare earth elements (also called lanthanides), zinc and selenium. In embodiments, the J304 alloy contains less than about 1.5 weight percent impurities, such as less than about 1.0 weight percent impurities, or less than about 0.5 weight percent impurities, or less than about 0.3 weight percent impurities.

In embodiments, the J304 alloy is free of intentional additions of cobalt, vanadium, phosphorus, sulfur, aluminum, arsenic, bismuth, calcium, magnesium, nitrogen, lead, tin, yttrium, rare earth elements, zinc, selenium, tantalum, titanium, hafnium and zirconium. The phrase "free of intentional additions" indicates, for example, that such elements are not intentionally added, but may be incidentally present due to processing materials and conditions. For example, certain elements may be present in stock used to make alloys. Further, because sulfur and phosphorus are common impurities which are removed during alloy preparation, complete elimination of these elements from the alloy may not be cost effective. In embodiments, the alloy may contain less than about 0.05 weight percent sulfur and/or less than about 0.05 weight percent phosphorus. Aluminum may be present in amounts up to about 0.005 weight percent, up to about 0.003 weight percent, or up to about 0.005 weight percent.

In embodiments, the content of sulfur is preferably less than about 0.05 weight percent and the content of phosphorus is preferably less than about 0.05 weight percent. For example, phosphorus and sulfur may each be present in the J304 alloy in an amount less than about 0.03 weight percent, such as from zero to about 0.03 weight percent, or from about 0.001 to about 0.03 weight percent, or from about 0.01 to about 0.03 weight percent phosphorus and/or sulfur.

In embodiments, nitrogen may be present in the J304 alloy in an amount less than about 0.1 weight percent, such as from about 0.04 to about 0.09 weight percent nitrogen.

EXAMPLES

The examples set forth herein below are illustrative of different compositions and conditions that may be used in practicing the embodiments of the present disclosure. All proportions are by weight unless otherwise indicated. It will be apparent, however, that the embodiments may be practiced with many types of compositions and can have many uses in accordance with the disclosure above and as pointed out hereinafter.

Alloy J303 is a ferritic alloy which possesses excellent yield strength from ambient to elevated temperatures such as 800° F. A significant amount of eutectic carbide is also a part of the alloy microstructure. J303 also demonstrates good corrosion resistant and its corrosion resistance is closely related to its chromium content. However, with increases in chromium and molybdenum contents in the alloy system, there is a tendency for sigma phase precipitation at elevated temperature which results in lower toughness.

Alloy J303 has a high carbon content (around 1.5 wt. %), and most of the carbon atoms in J303 are bound up in a primary and eutectic carbide phase. Together with relative low manganese content range, the potential of austenitic phase formation in J303 is relative low.

In order to improve toughness, experiments were conducted to develop an alloy with austenitic microstructure with good corrosion resistance. Nine experiments (Heats 1-9) were made to explore the alloying element effect on matrix structure formation with compositions summarized in Table 1.

TABLE 1

Alloy Compositions J304 (Heats 1-9)

| | 1 | 2 | 3 | 4 | 5 | 6 | 7 | 8 | 9 |
|---|---|---|---|---|---|---|---|---|---|
| C | 0.144 | 0.26 | 0.549 | 0.632 | 0.462 | 0.690 | 0.560 | 0.732 | 0.621 |
| Mn | 0.221 | 0.2 | 0.249 | 0.960 | 0.711 | 1.27 | 0.942 | 2.21 | 3.05 |
| Si | 0.208 | 0.199 | 0.245 | 0.180 | 0.204 | 0.371 | 0.253 | 0.185 | 0.232 |
| Ni | 4.36 | 3.89 | 3.43 | 3.76 | 3.67 | 6.19 | 6.2 | 6.09 | 5.99 |
| Cr | 14.21 | 14.48 | 14.13 | 14.54 | 14.13 | 15.01 | 14.29 | 14.01 | 14.18 |
| Mo | 14.82 | 14.58 | 14.8 | 14.67 | 14.5 | 14.36 | 14.7 | 14.77 | 14.91 |
| Cu | 1.11 | 0.942 | 0.826 | 0.755 | 0.918 | 1.11 | 0.955 | 0.902 | 0.849 |
| w | 0.069 | 0.041 | 0.037 | 0.063 | 0.029 | 0.019 | 4.7 | 5.05 | 5.82 |
| V | 0.046 | 0.046 | 0.04 | 0.061 | 0.057 | 0.028 | 0.045 | 0.052 | 0.033 |
| Co | 0.082 | 0.038 | 0.019 | 0.027 | 0.007 | 0.005 | 0.01 | 0.014 | 0.015 |

TABLE 1-continued

| Alloy Compositions J304 (Heats 1-9) | | | | | | | | | |
|---|---|---|---|---|---|---|---|---|---|
| | 1 | 2 | 3 | 4 | 5 | 6 | 7 | 8 | 9 |
| Fe | 63.6 | 64.4 | 64.8 | 63.6 | 64.8 | 60.4 | 56.2 | 54.9 | 53.1 |
| P | 0.0298 | 0.0306 | 0.0306 | 0.0328 | 0.0310 | 0.0304 | 0.0339 | 0.0367 | 0.0387 |
| s | 0.0267 | 0.02 | 0.0186 | 0.0128 | 0.013 | 0.0118 | 0.0065 | 0.0062 | 0.0044 |
| N | 0.0907 | 0.0842 | 0.0538 | 0.0731 | 0.0582 | 0.0484 | 0.0428 | 0.505 | 0.0435 |
| Nb | 0.662 | 0.518 | 0.421 | 0.291 | 0.133 | 0.186 | 0.192 | 0.148 | 0.121 |
| B | 0.0059 | 0.006 | 0.0058 | 0.0071 | 0.01 | 0.0075 | 0.0067 | 0.0054 | 0.0053 |
| Al | 0.0005 | 0.0005 | 0.0005 | 0.0005 | 0.0005 | 0.0008 | 0.0006 | 0.0012 | 0.0031 |

For a comparison, the specification and nominal composition of J303 are listed in Table 2. It can be noted that basic amounts of chromium plus molybdenum content has not been changed in alloy J304 (Heats 1-9).

Carbon, manganese nickel, and nitrogen are strong austenite formers. Thus, with an increase in the amounts of any of those elements, the potential of austenite formation increases. On the other hand, silicon, chromium, molybdenum, niobium, and tungsten are ferrite formers. Although tungsten is a ferrite former, tungsten is also a potential carbide former and strong solid solution strengthening element for austenite.

TABLE 2

| J303 Nominal, Control and Specification Ranges | | | |
|---|---|---|---|
| Item | Nominal | Control Limit | Alloy Specification |
| C | 1.5 | 1.50-1.60 | 1.45-1.65 |
| Mn | 0.45 | 0.35-0.55 | 0.3-0.6 |
| Si | 1.00 | 0.85-1.15 | 0.80-1.20 |
| Ni | 1.00 | 0.90-1.10 | 0.85-1.15 |
| Co | 0.5 | 0.50-0.60 | 0.35-0.65 |
| B | 0.15 | 0.11-0.18 | 0.09-0.20 |
| V | 2.60 | 2.50-2.70 | 2.30-3.00 |
| Nb | 2.00 | 1.75-2.25 | 1.50-2.50 |
| Cr | 15.0 | 14.5-16.25 | 14.25-16.5 |
| Mo | 15.0 | 14.5-16.25 | 14.25-16.5 |
| Cr + Mo | 30.0 | 29.0-31.0 | 28.0-32.0 |
| N | 0.35 | Up to 0.5 | Up to 0.5 |
| Fe + incidentals | Balance | 55-65 | 53-68 |

Table 3 shows magnetism behavior of the nine experiments. Only three experimental heats showed non-magnetic behavior as fully austenitic microstructure alloy. The fully austenitic microstructure formation is a combination effect from all the alloying elements studied. Comparing Heat 6 (J304-6) and Heat 7 (J304-7), when silicon exceeds a threshold amount, ferrite will be formed. For the heats studied, when the silicon content is equal to or greater than 0.371 wt. %, ferrite will form in the alloy system.

TABLE 3

| Magnetism in Experiments | | | | |
|---|---|---|---|---|
| Alloy | Heat # | EXP. | Magnetic | Non-Magnetic |
| J304-1 | 0G22XA | X | X | |
| J304-2 | 0G27XA | X | X | |
| J304-3 | 0G29XA | X | X | |
| J304-4 | 0H11XA | X | X | |
| J304-5 | 0H17XA | X | X | |
| J304-6 | 0H18XA | X | X | |
| J304-7 | 0H19XA | X | | X |
| J304-8 | 0H25XA | X | | X |
| J304-9 | 0H26XA | X | | X |

In view of the test results, a fully austenitic Fe—Cr—Mo alloy can be achieved with adjustment of the carbon, manganese, nickel and silicon content.

Figure 2A:
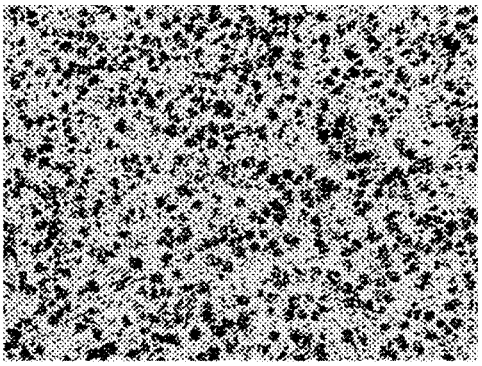
FIG. 2*a* is a micrograph at 100× of the microstructure of alloy J303 at 100× and FIG. 2*b* shows the microstructure at 500×.
Figure 2B:
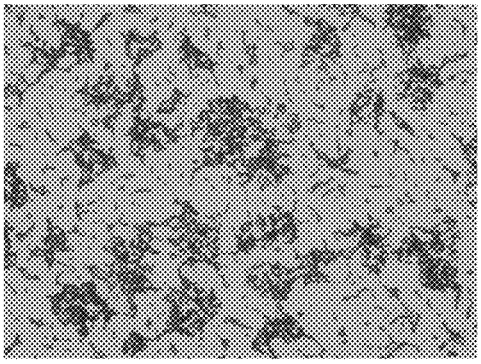
Figure 3:
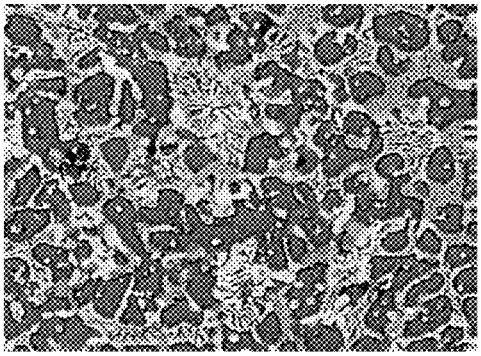
FIG. 3 is a secondary electron image showing the typical microstructural morphology in alloy J303.

Per the results observed, there is a threshold point which can be reached by adjusting carbon, manganese, nickel, and silicon content in the J303 alloy system to obtain a high percentage of austenitic microstructure in the alloy. A typical microstructure in the J303 alloy is shown in FIGS. 2*a-b* which are at 100× and 500× magnifications, respectively. The intragranular region is fully ferritic phase while the intergranular is composed of eutectic reaction phases. To confirm intergranular microstructural morphology, a higher magnification SEM secondary electron image (1000×) was exhibited in FIG. 3. As shown in FIG. 3, almost all of the intergranular regions are composed of eutectic reactant phases in Alloy J303.

In Experiments 1 through 9, the alloy compositions were made without significantly changing the amounts of Fe, Cr and Mo. For all nine Experiments, the alloys are V-free and Co-free in that vanadium and cobalt are not intentionally included thus only trace amount of these elements could be detected. Niobium content has been substantially reduced from 2.0 wt. % in J303 to within a range of 0.133 to 0.662 wt. % varying per individual Experiment. Tungsten has been added in Experiments 7 through 9 which is not an intentional addition in alloy J303. Typical microstructural morphology for J303 and Experiments 1-9 were examined in the as-cast condition.

Figure 4A:
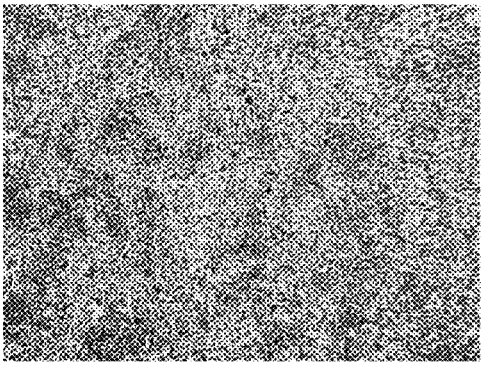
FIG. 4*a* is a micrograph at 100× of the microstructure of an alloy in Experiment 1 at 100× and FIG. 4*b* shows the microstructure at 500×.
Figure 4B:
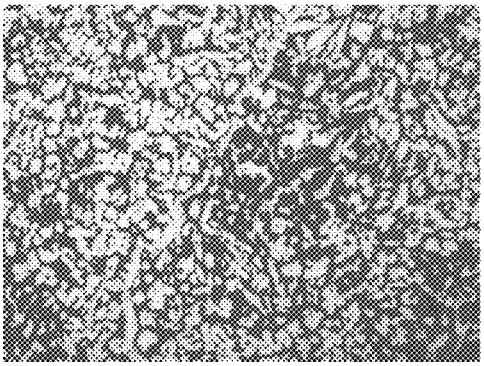

FIGS. 4*a-b* show the typical microstructure of Experiment 1 (J304-1) which displays a duplex (austenitic and ferritic) microstructural morphology at 100× (FIG. 4*a*) and 500× (FIG. 4*b*).

Figure 5A:
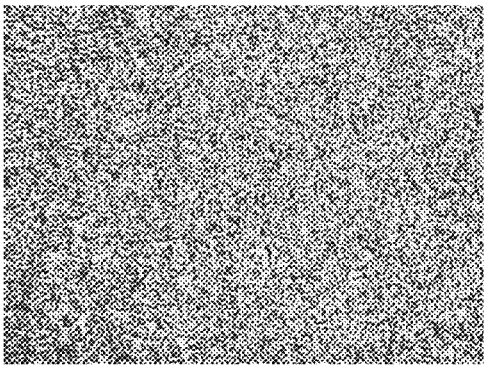
FIG. 5*a* is a micrograph at 100× of the microstructure of an alloy in Experiment 2 at 100× and FIG. 5*b* shows the microstructure at 500×.
Figure 5B:
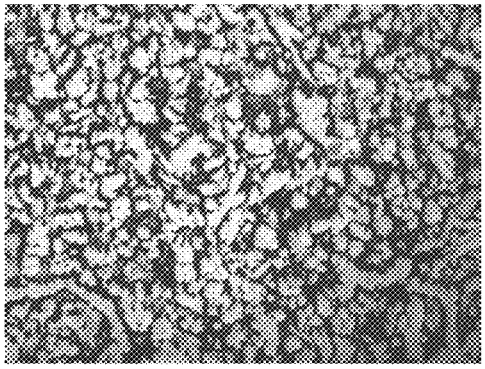

FIGS. 5*a-b* show the typical microstructural morphology in Experiment 2 (J304-2) displaying duplex (austenitic and ferritic) microstructures at 100× (FIG. 5*a*) and 500× (FIG. 5*b*). A random granular distribution of austenitic and ferritic phases has been observed in Experiment 1 though a hint of larger granular morphology in Experiment 2 can be also detectable.

Figure 6A:
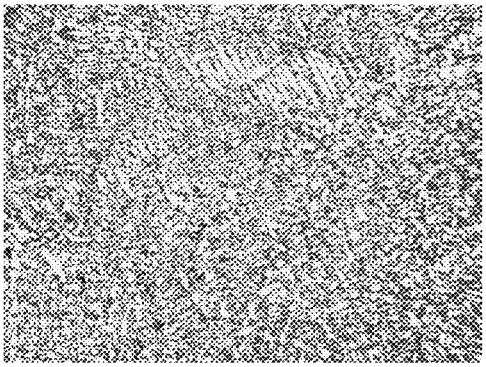
FIG. 6*a* is a micrograph at 100× of the microstructure of an alloy in Experiment 3 at 100× and FIG. 6*b* shows the microstructure at 500×.
Figure 6B:
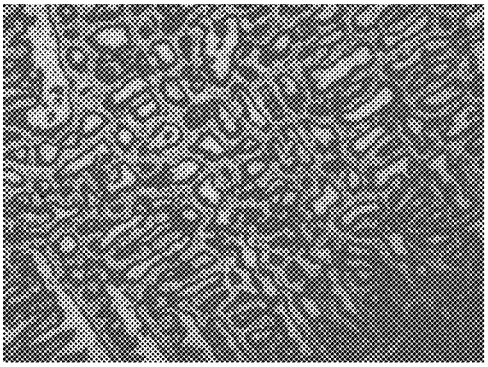

FIGS. 6*a-b* show typical microstructure in Experiment 3 (J304-3) at 100× (FIG. 6*a*) and 500× (FIG. 6*b*) in which a directional cellular dendritic morphology can be clearly evidenced and the interdendritic regions are mainly composed of ferrite. The primary compositional difference among Experiments 1 through 3 is carbon content. The result indicates that with an increase in carbon content from a range of 0.144 to 0.549 wt. %, the random granular morphology changed to a directional cellular dendritic morphology.

Figure 7A:
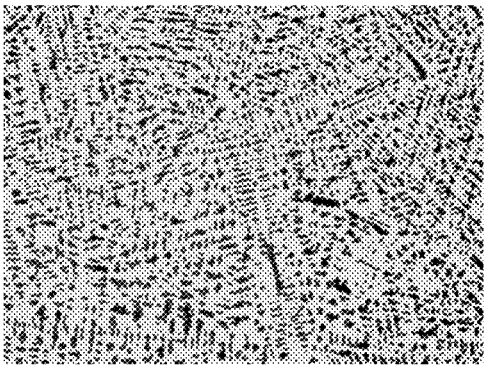
FIG. 7*a* is a micrograph at 100× of the microstructure of an alloy in Experiment 4 at 100× and FIG. 7*b* shows the microstructure at 500×.
Figure 7B:
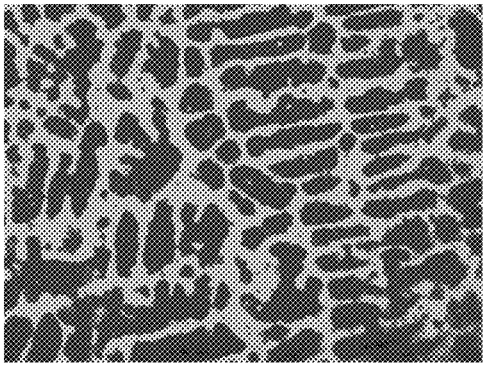

Experiment 4 (J304-4) has been carried out with 1.0 wt. % of manganese compared to Experiment 3. It can be clearly seen in FIGS. 7*a-b* that the typical microstructure in Experiment 4 at 100× (FIG. 7*a*) and 500× (FIG. 7*b*) has a region of interdendritic region which became significantly enlarged in Experiment 4 compared to Experiment 3. In addition, the directional solidification mode became significantly stronger in Experiment 4.

Figure 8A:
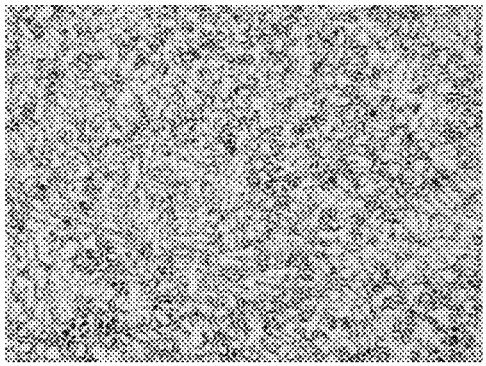
FIG. 8*a* is a micrograph at 100× of the microstructure of an alloy in Experiment 5 at 100× and FIG. 8*b* shows the microstructure at 500×.
Figure 8B:
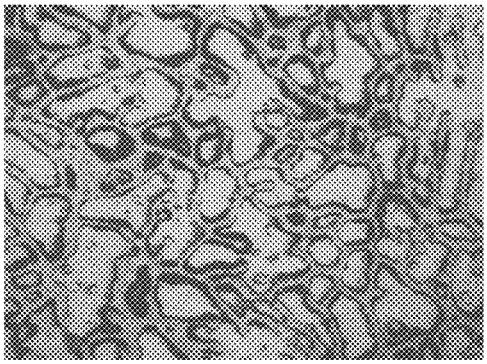

Compared to Experiment 4, Experiment 5 (J304-5) has slightly reduced carbon and manganese content which displays a lower directional solidification mode tendency along with a smaller interdendritic region as exhibited in FIGS. 8*a-b* which show the typical microstructure of Experiment 5 at 100× (FIG. 8*a*) and 500× (FIG. 8*b*).

Figure 9A:
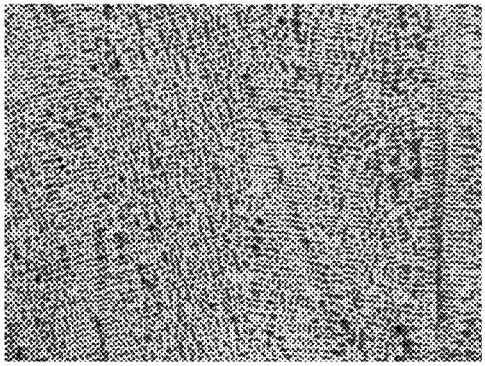
FIG. 9*a* is a micrograph at 100× of the microstructure of an alloy in Experiment 6 at 100× and FIG. 9*b* shows the microstructure at 500×.
Figure 9B:
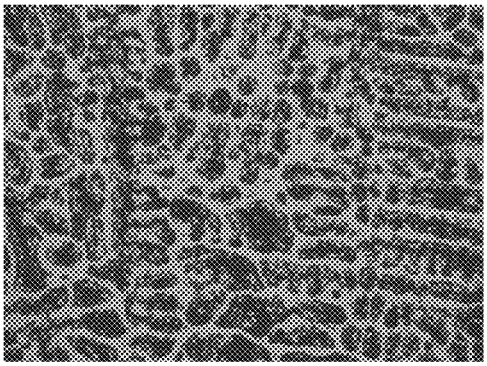

Compared to Experiment 4, Experiment 6 (J304-6) has significantly augmented manganese and nickel content displaying a high dendritic solidification mode tendency as shown in FIGS. 9*a-b* which show the typical microstructure in Experiment 6 at 100× (FIG. 9*a*) and 500× (FIG. 9*b*). Due to higher chromium content in Experiment 6, the primary microstructure is composed of ferrite.

Figure 10A:
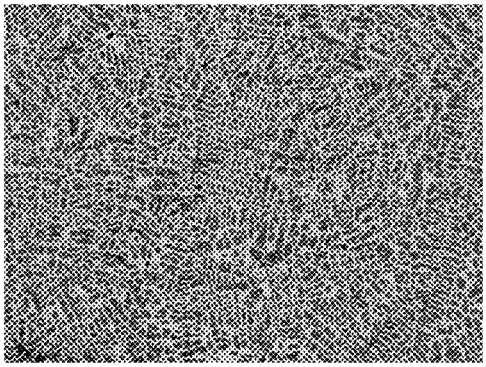
FIG. 10*a* is a micrograph at 100× of the microstructure of an alloy in Experiment 7 at 100× and FIG. 10*b* shows the microstructure at 500×.
Figure 10B:
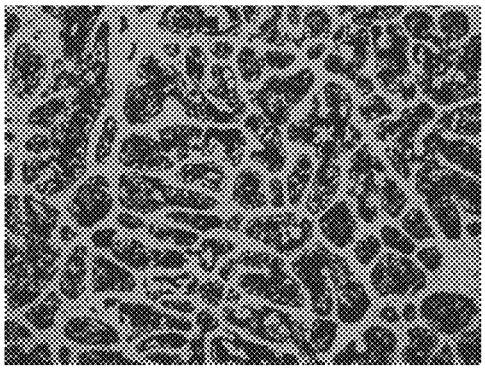

Compared to Experiment 6, Experiment 7 (J304-7) is with addition of 4.7 wt. % of tungsten. As a result, Experiment 7 possesses an even finer cellular dendritic substructure along with a greater random cellular distribution tendency. FIGS. 10*a-b* show the typical microstructure in Experiment 7 100× (FIG. 10*a*) and 500× (FIG. 10*b*).

Figure 11A:
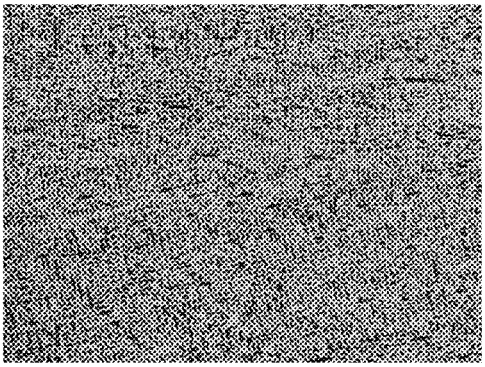
FIG. 11*a* is a micrograph at 100× of the microstructure of an alloy in Experiment 8 at 100× and FIG. 11*b* shows the microstructure at 500×.
Figure 11B:
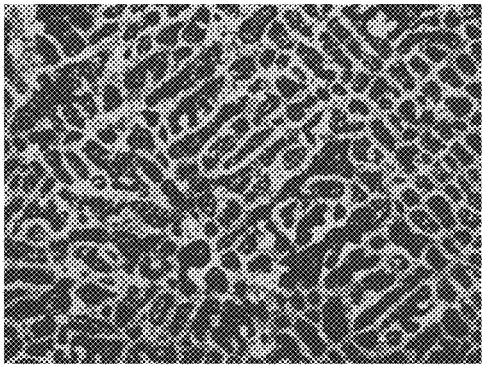

Compared to Experiment 7, amount of manganese increased from 0.942 wt. % to 2.21 wt. % in Experiment 8 (J304-8). Further reduction of the cellular dendritic size and randomness of cellular dendritic orientation in Experiment 8 can be clearly shown in FIGS. 11*a-b* which show the typical microstructure in Experiment 8 at 100× (FIG. 11*a*) and 500× (FIG. 11*b*).

Figure 12A:
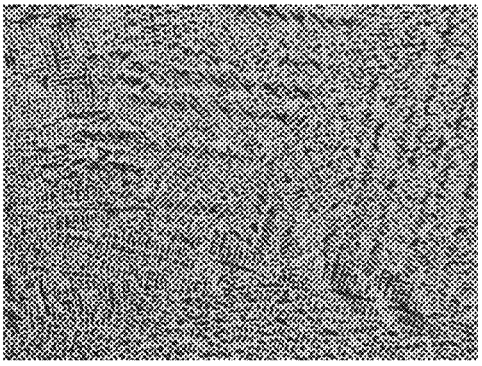
FIG. 12*a* is a micrograph at 100× of the microstructure of an alloy in Experiment 9 at 100× and FIG. 12*b* shows the microstructure at 500×.
Figure 12B:
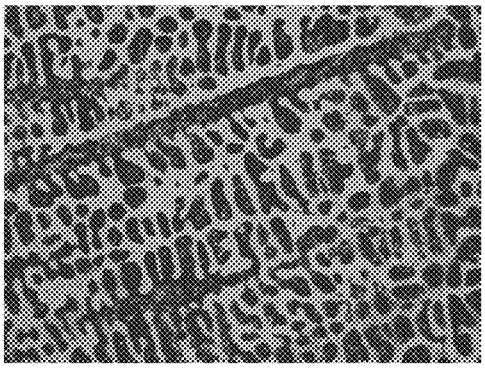

Compared to Experiment 8, the amount of manganese increased from 2.21 wt. % to 3.05 wt. % in Experiment 9 (J304-9). An amount of interdendritic region was substantially enlarged with reduced intradendritic region as shown in FIGS. 12*a-b* which show the typical microstructure in Experiment 9 at 100× (FIG. 12*a*) and 500× (FIG. 12*b*).

In view of the experiments conducted, it can be concluded that compared to the J303 alloy system, reducing carbon and silicon while increasing nickel and adding copper, the microstructure can be changed from a ferritic microstructure to a duplex ferrite+austenite microstructure. For example, decreasing carbon from 1.55 wt. % to ≤0.732 wt. %, decreasing silicon from 1.00 wt. % to ≤0.245 wt. %, increasing nickel from 1.00 wt. % to ≥3.43 wt. %, adding copper to ≥0.755 wt. %, the microstructure changes from fully ferritic to duplex (ferrite and austenite) microstructural matrix. Further, compared to the J303 alloy, cobalt can be excluded and still achieve the duplex microstructure, and primary carbide included in the interdendritic eutectic reaction phase in alloy J303 does not appear in any of the nine J304 alloys.

In order to obtain a fully austenitic microstructure, the Fe-14.5Cr-14.5Mo alloy system can be modified to include various alloying elements in selected ranges as shown in Experiments 7-9. Contrary to the expectation that tungsten would increase ferrite formation, in J304 the tungsten addition does not promote ferrite formation possibly due to formation of an iron tungsten intermetallic phase in the intradendritic region.

Figure 13:
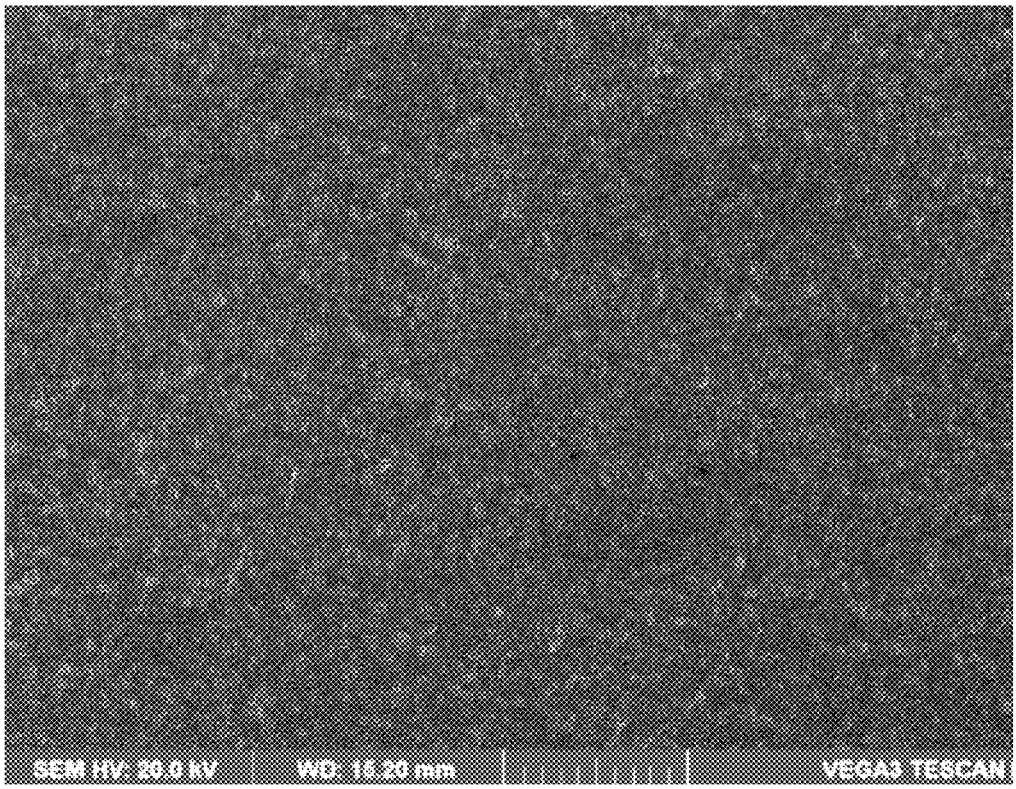
FIG. 13 shows a secondary electron image at 500× of alloy J304 (Heat 1).

FIG. 13 shows a secondary electron image at 500× of alloy J304 (Heat 1). It reveals a very fine and uniform microstructure. Clearly, there is no intergranular/interdendritic eutectic formation in alloy J304 compared to alloy J303 in which the intergranular eutectic reaction phases is a signature microstructural morphology.

A higher magnification secondary electron image and backscattered electron image at 1000× are shown in FIGS. 14 and 5, respectively. The primary matrix microstructure is the same for both intragranular and intergranular regions. The variation of alloying elemental concentration between dendritic and interdendritic regions can be exhibited in the backscattered electron image.

FIG. 16 is a backscattered electron image at even higher magnification in which small area EDS analysis, brighter area EDS analysis, and darker area EDS analysis were taken place at the locations marked in the figure. The EDS analysis results for above three locations are shown in FIGS. 17-19, respectively. The primary conclusion obtained from these results is J304 Heat 1 is a single-phase alloy and the difference between intragranular and intergranular is a small change in amount of alloying elements such as Cr and Mo.

FIG. 20 shows a secondary electron image at 500× of alloy J304 Heat 8. Clearly, the matrix also has the same microstructure of the intragranular and intergranular regions. Under the higher magnification at 0.1000× shown in FIGS. 21 and 22, it is revealed that Heat 8 possesses a greater interdendritic area compared to Heat 1.

Comparing the results shown in FIGS. 20-22, the primary difference among the three locations EDS analyzed is the intergranular phase is richer in Cr, Mo, and W in J304 Heat 8 which is formed during the alloy solidification process. FIG. 23 shows an even higher magnification backscattered electron image at 2000× for J304 Heat 8 in which the locations EDS analyzed are marked. The EDS analysis results for above three locations are shown in FIGS. 24-26, respectively.

In elemental dot mapping for Heat 1 and 8, respectively, Heat 8 possessed a higher percentage of interdendritic region compared to Heat 1.

Bulk hardness versus tempering temperature was evaluated for J304 Heats 1, 2, 4, 5 and 7-9 as shown in Table 4. In the tests, for each tempering temperature five samples were prepared and tested. The average value (of the five samples) is used to make the graph. The samples were subjected to hardening and then tempering by heating to 1700° F. for 2.5 hours, air quenching and tempering at a particular temperature for 3.5 hours followed by air cooling.

TABLE 4

| Bulk Hardness (hardness values in HRc) | | | | | | | |
|---|---|---|---|---|---|---|---|
| Temp ° F. | Heat 1 | Heat 2 | Heat 4 | Heat 5 | Heat 7 | Heat 8 | Heat 9 |
| 75 | 56.3 | 55 | 53.5 | 52.63 | 48.6 | 46.7 | 51.7 |
| 800 | 58.4 | 57.5 | 54.4 | 53.83 | 48.8 | 47.8 | 51.6 |
| 900 | 59.6 | 57.9 | 54.2 | 53.82 | 49.5 | 48.1 | 51.6 |
| 1000 | 57.5 | 56.5 | 53 | 53.08 | 49.3 | 48.3 | 51.9 |
| 1050 | 57.7 | 55 | 51.2 | 51.37 | 49.3 | 47.8 | 51.9 |
| 1100 | 56.7 | 53.7 | 49.9 | 50.31 | 49.6 | 48.3 | 52 |
| 1150 | 55.7 | 53.6 | 49.3 | 48.94 | 49.7 | 48.4 | 52.1 |
| 1200 | 55.6 | 53.5 | 49.3 | 48.97 | 49 | 48 | 52 |

TABLE 4-continued

| Bulk Hardness (hardness values in HRc) | | | | | | | |
|---|---|---|---|---|---|---|---|
| Temp ° F. | Heat 1 | Heat 2 | Heat 4 | Heat 5 | Heat 7 | Heat 8 | Heat 9 |
| 1250 | 55.8 | 53.3 | 49.5 | 49.16 | 49.2 | 48.1 | 52.6 |
| 1300 | 56.3 | 54.9 | 50 | 50.61 | 48.9 | 47.7 | 51.7 |
| 1350 | 57.3 | 55.3 | 50.1 | 49.6 | 49 | 47.3 | 52 |
| 1400 | 56.8 | 55.5 | 50.8 | 51.28 | 49.7 | 47.8 | 52.4 |
| 1450 | 56.5 | 55.3 | 51.7 | 51.47 | 49.1 | 48.1 | 52.6 |
| 1500 | 56.8 | 55.6 | 51.5 | 51.63 | 49.1 | 47.8 | 52.4 |

FIG. 27 is a graph of bulk hardness versus tempering temperature for the Heats listed in Table 4 wherein 0G22XA is Heat 1, 0G27XA is Heat 2, 0H11XA is Heat 4, 0H17XA is Heat 5, 0H19XA is Heat 7, 0H25XA is Heat 8 and 0H26XA is Heat 9.

Radial crush strength versus tempering temperature was evaluated for J304 Heats 1, 2, 4, 5 and 7-9 as shown in Table 5. In the tests, for each tempering temperature five samples were prepared and tested. The average value (of the five samples) is used to make the graph. The samples were subjected to hardening and then tempering by heating to 1700° F. for 2.5 hours, air quenching and tempering at a particular temperature for 3.5 hours followed by air cooling.

TABLE 5

| Radial Crush Strength (radial crush strength values in 8.33 × ft-lbf) | | | | | | | |
|---|---|---|---|---|---|---|---|
| Temp ° F. | Heat 1 | Heat 2 | Heat 4 | Heat 5 | Heat 7 | Heat 8 | Heat 9 |
| 75 | 0.249 | 0.212 | 0.537 | 0.497 | 0.519 | 0.596 | 0.393 |
| 800 | 0.215 | 0.393 | 0.671 | 0.720 | 0.780 | 0.95 | 0.808 |
| 900 | 0.280 | 0.415 | 0.724 | 0.732 | 0.719 | 0.954 | 0.657 |
| 1000 | 0.295 | 0.409 | 0.630 | 0.621 | 0.855 | 0.979 | 0.625 |
| 1050 | 0.363 | 0.418 | 0.729 | 0.520 | 0.919 | 0.916 | 0.551 |
| 1100 | 0.667 | 0.434 | 0.594 | 0.649 | 0.871 | 0.861 | 0.721 |
| 1150 | 0.439 | 0.437 | 0.788 | 0.796 | 0.9939 | 0.543 | 0.524 |
| 1200 | 0.531 | 0.446 | 0.556 | 0.901 | 0.691 | 0.820 | 0.573 |
| 1250 | 0.363 | 0.473 | 0.818 | 0.947 | 1.036 | 0.937 | 0.800 |
| 1300 | 0.250 | 0.241 | 0.417 | 0.516 | 0.477 | 0.490 | 0.525 |
| 1350 | 0.317 | 0.390 | 0.625 | 1.100 | 0.974 | 0.844 | 0.545 |
| 1400 | 0.439 | 0.529 | 0.589 | 0.658 | 0.692 | 0.859 | 0.533 |
| 1450 | 0.525 | 0.418 | 0.610 | 0.796 | 0.815 | 1.123 | 0.678 |
| 1500 | 0.410 | 0.392 | 0.603 | 0.698 | 0.549 | 0.882 | 0.613 |

FIG. 28 is a graph of radial crush strength versus tempering temperature for the Heats listed in Table 5 wherein 0G22XA is Heat 1, 0G27XA is Heat 2, 0H11XA is Heat 4, 0H17XA is Heat 5, 0H19XA is Heat 7, 0H25XA is Heat 8 and 0H26XA is Heat 9.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A low-carbon iron-chromium-molybdenum alloy comprising, in weight percent: carbon from about 0.1 to about 0.8 percent; manganese from about 0.1 to about 4 percent; silicon from about 0.1 to about 0.5 percent; chromium from 14 to about 16 percent; nickel up to about 8 percent; vanadium up to about 0.1 percent; molybdenum from 14 to about 16 percent; tungsten up to about 6 percent; niobium from about 0.1 to about 0.8 percent; cobalt up to about 0.2 percent; boron up to 0.1 percent; nitrogen up to about 0.1 percent; copper up to about 1.5 percent; sulfur up to about 0.05 percent; phosphorus up to about 0.05 percent; balance iron from about 50 to about 65 percent; and incidental impurities wherein the alloy contains a ratio of Cr/Mo of about 0.9 to about 1.1.

2. The alloy according to claim 1, wherein the alloy comprises: carbon from about 0.15 to about 0.75 percent; manganese from about 0.2 to about 3 percent; silicon from about 0.2 to about 0.4 percent; chromium from 14.5 to about 15.5 percent; nickel from about 3 to about 6 percent; vanadium from about 0.02 to about 0.06 percent; molybdenum from 14.5 to about 15.5 percent; tungsten from about 0.02 to about 6 percent; niobium from about 0.1 to about 0.7 percent; cobalt from about 0.005 to about 0.1 percent; boron from about 0.005 to about 0.01 percent; nitrogen from about 0.04 to about 0.09 percent; copper from about 0.6 to about 1.2 percent; sulfur up to about 0.03 percent; phosphorus up to about 0.03 percent; balance iron from about 53 to about 63 percent; and incidental impurities.

3. The alloy according to claim 1, comprising: carbon from about 0.1 to about 0.8 percent; manganese from about 1 to about 3 percent; silicon from about 0.2 to about 0.4 percent; chromium from 14.5 to about 15.5 percent; nickel from about 5 to about 6 percent; vanadium up to about 0.1 percent; molybdenum from 14.5 to about 15.5 percent; tungsten about 4 to about 6 percent; niobium from about 0.1 to about 0.2 percent; cobalt up to about 0.1 percent; boron up to about 0.1 percent; nitrogen up to about 0.1 percent; copper 0.8 to about 1.2 percent; sulfur up to about 0.03 percent; phosphorus up to about 0.03 percent; balance iron from about 50 to about 56 percent; and incidental impurities.

4. The alloy according to claim 1, wherein the alloy contains about 50 to about 65 weight percent iron, about 3 to about 8 percent nickel, about 0.7 to about 1.5 percent copper, up to 0.1 percent cobalt, up to 0.07 percent vanadium, about 0.1 to about 0.7 percent niobium and up to about 0.005 percent aluminum.

5. The alloy according to claim 1, wherein the alloy has a hardness of at least 47 Rockwell C.

6. The alloy according to claim 1, wherein the alloy has a microhardness (HV10) of at least 350 at a temperature of about 1000° F.

7. The alloy according to claim 1, wherein the alloy consists essentially of, in weight percent: carbon from 0.1 to 0.8 percent; manganese from 0.2 to 3.5 percent; silicon from 0.1 to 0.4 percent; chromium from 14.5 to about 15.5 percent; nickel from 3 to 6.5 percent; vanadium up to 0.1 percent; molybdenum from 14.5 to about 15.5 percent; tungsten up to 6 percent; niobium about 0.1 to about 0.7 percent; cobalt up to 0.1 percent; boron up to 0.1 percent; nitrogen up to 0.1 percent; copper 0.7 to 1.2 percent; sulfur up to 0.03 percent; phosphorus up to 0.03 percent; balance iron from 50 to 65 percent; and incidental impurities wherein a ratio of chromium to molybdenum is 0.9 to 1.1.

8. The alloy according to claim 1, wherein the alloy is vanadium-free.

9. The alloy according to claim 1, wherein the alloy is cobalt-free.

10. A cast part comprising the alloy according to claim 1, wherein the cast part is free of primary carbides and has a fully austenitic microstructure, fully ferritic microstructure or duplex ferritic-austenitic microstructure.

11. The cast part according to claim 10, wherein the cast part has a fully austenitic microstructure.

12. The cast part according to claim 10, wherein the cast part has a fully ferritic microstructure.

13. The cast part according to claim 10, wherein the cast part has a duplex ferritic-austenitic microstructure.

14. A valve seat insert made from the alloy according to claim 1.

* * * * *